US006120342A

United States Patent [19]

Chan

[11] Patent Number: 6,120,342

[45] Date of Patent: Sep. 19, 2000

[54] WHISTLING DISK

[75] Inventor: Pak Nin Chan, Kowloon, The Hong Kong Special Administrative Region of the People's Republic of China

[73] Assignee: Candy Novelty Works Ltd., Kowloon, The Hong Kong Special Administrative Region of the People's Republic of China

[21] Appl. No.: 08/979,048

[22] Filed: Nov. 26, 1997

[51] Int. Cl.[7] ..... A63H 1/32

[52] U.S. Cl. ..... 446/254; 446/247

[58] Field of Search ..... 446/245, 247, 446/251, 252, 253, 254, 258, 265, 46

[56] References Cited

U.S. PATENT DOCUMENTS

| | | | |
|---|---|---|---|
| 509,044 | 11/1893 | McCall | 446/254 |
| 517,926 | 4/1894 | Kline . | |
| 773,072 | 10/1904 | Griffin | 446/258 |
| 905,684 | 12/1908 | Fowle | 446/253 |
| 1,440,053 | 12/1922 | Brett | 446/254 |
| 1,668,410 | 5/1928 | Keranen | 446/254 |
| 3,010,248 | 11/1961 | Ellman et al. . | |
| 3,131,506 | 5/1964 | Fox | 446/253 |
| 4,189,862 | 2/1980 | Lopez | 446/254 |
| 4,297,809 | 11/1981 | Branson | 446/46 |

*Primary Examiner*—Robert A. Hafer
*Assistant Examiner*—Jeffrey D. Carlson
*Attorney, Agent, or Firm*—Joan H. Pauly

[57] ABSTRACT

A sounding toy has a sounding member body that defines a plurality of circumferentially spaced internal cavities (12), each of which is enclosed except for a side opening (10) communicating therewith. A pair of flexible cords (30) extend axially through a center portion of the body (2). The cavities (12) and side openings (10) are configured to produce a whistling sound when the sounding member (2) is caused to rotate by winding and then tightening the cords (30). The geometry of the body (2) is chosen to force air into the cavities (12) when the body (2) is rotating in either direction about its axis.

21 Claims, 3 Drawing Sheets

FIG. 1
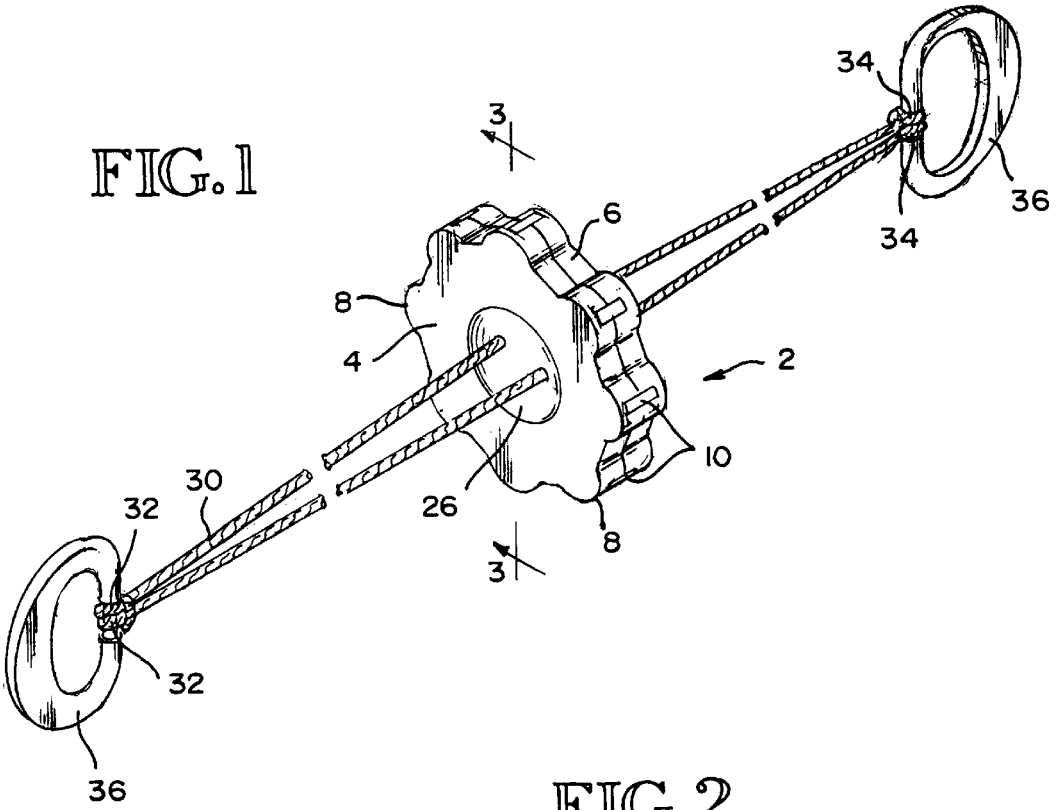
FIG. 2
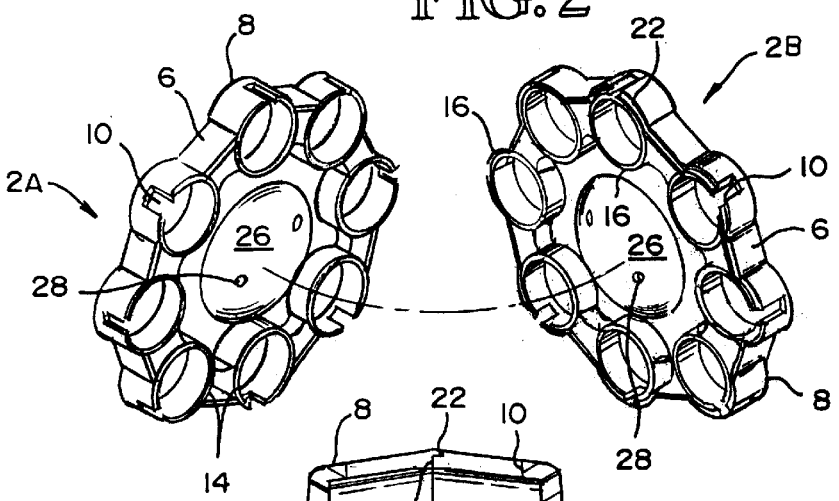
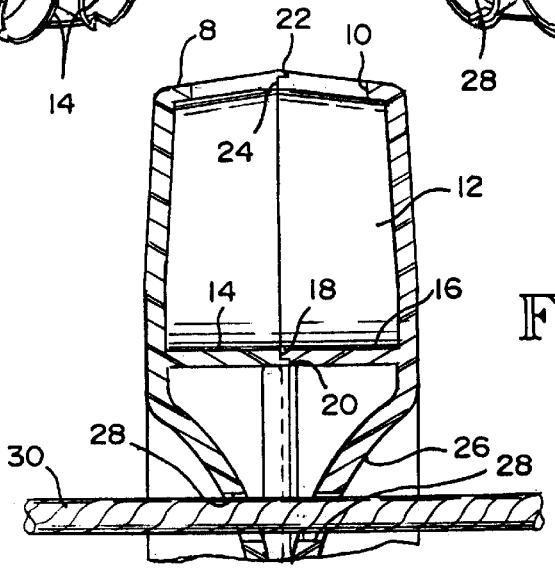
FIG. 3

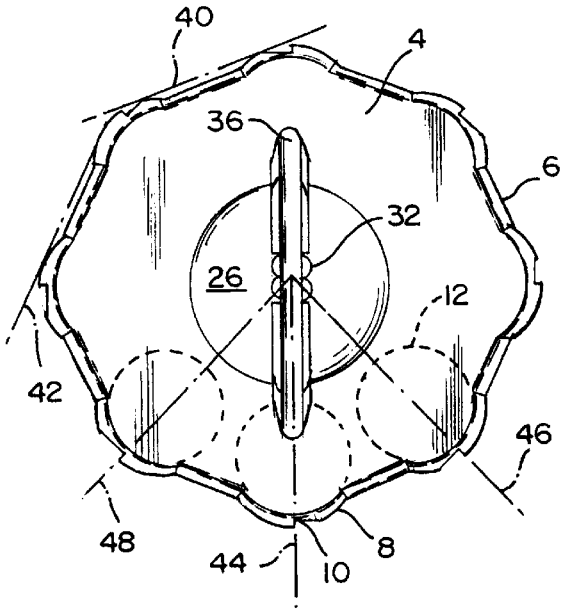
FIG. 6A
FIG. 6B
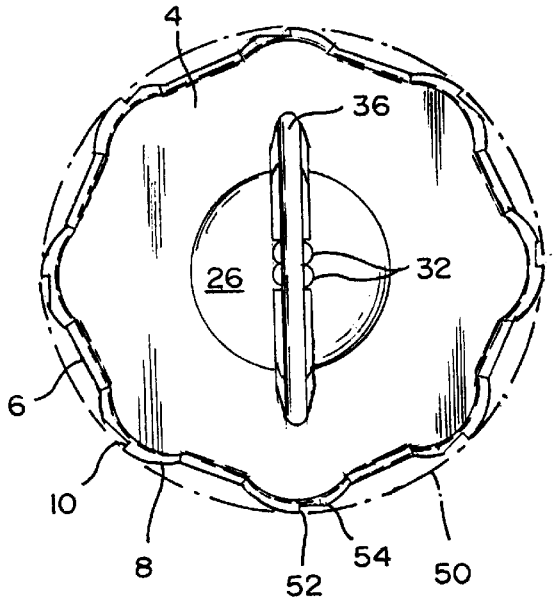
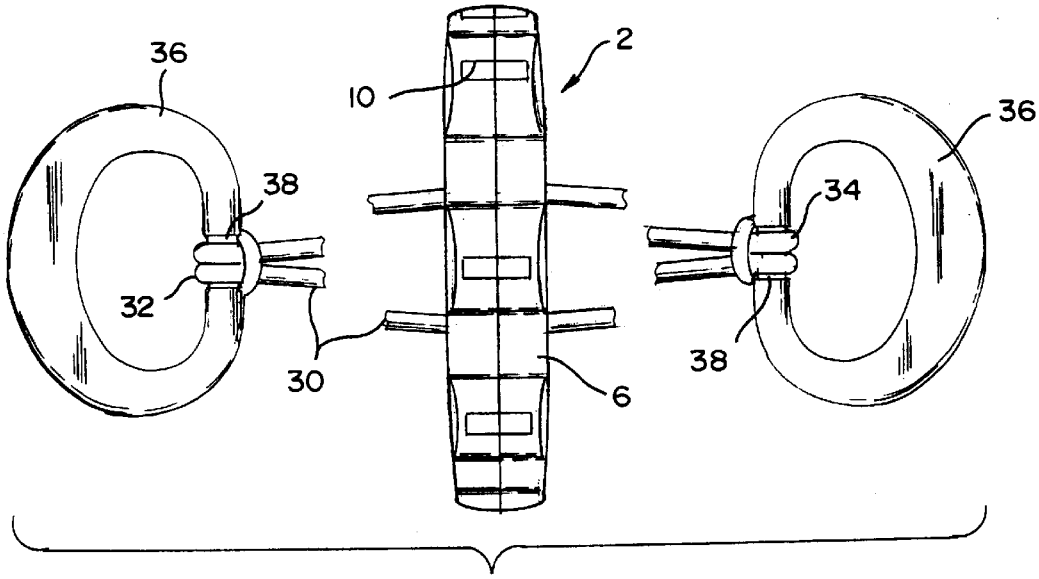
FIG. 7

WHISTLING DISK

TECHNICAL FIELD

This invention relates to sounding toys and, more particularly, to such a toy having a sounding member with a plurality of internal cavities and side openings communicating with the cavities, and a pair of flexible cord members extending axially through the member. The cavities and side openings are configured to produce a whistling sound when the sounding member is caused to rotate by winding and then tightening the cord members.

BACKGROUND INFORMATION

There is always a demand for low cost amusement devices for children and/or adults. One way of providing the desired amusement is for the device to make a sound when manipulated by the user. Various types of sounding toys are known. Known sounding toys commonly have either the disadvantage of not effectively making the desired sound or the disadvantage of being overly complex. Thus, there is a market for new sounding toys that are relatively inexpensive and simple in structure but reliably and effectively make the desired sound.

The object of the present invention is to provide an improved sounding toy that is inexpensive, simple in structure, and easy to operate to effectively produce the desired sound.

SUMMARY OF THE INVENTION

The subject of the invention is a sounding toy. According to an aspect of the invention, the toy comprises a sounding member and a pair of flexible cord members. The sounding member has a body defining a plurality of circumferentially spaced internal cavities. Each cavity is enclosed except for a side opening communicating therewith. The cord members extend axially through a center portion of the body. The cavities and side openings are configured to produce a whistling sound when the sounding member is caused to rotate by winding and then tightening the cord members.

The details of the geometry of the sounding member may be varied. The side openings are preferably arranged to direct flow of air around the rotating sounding member into the cavities to produce the whistling sound. A feature designed to accomplish this is a scoop-like arrangement of the side openings. The body of the sounding member has an outer circumferential sidewall through which the side openings extend. A circle circumscribing the sidewall substantially touches a first edge of each side opening and is spaced radially outwardly of a second opposite edge of the side opening.

Preferably, the side openings are arranged in a plurality of pairs of side openings with the two side openings in each pair being oriented toward a common plane. As used herein, the phrase "oriented toward a common plane" means that the openings face in substantially the same direction, or that a line tangent to the surfaces through which the openings extend touches an edge of each of the openings. Also preferably, the body of the sounding member has a substantially circular outer circumferential sidewall. The sidewall has a plurality of circumferentially spaced radial protuberances thereon through each of which one of the side openings extends.

In the preferred embodiment, each protuberance is defined by an at least substantially circular arc. Each cavity is substantially circular and concentric with the arc of the protuberance through which the corresponding side opening extends. For each pair of side openings, an area defined between two radial lines of the body preferably includes at least substantially the full extent of both side openings of the pair. The two radial lines respectively bisect the cavities corresponding to the side openings of the pair. Another feature of the preferred embodiment is side openings that are substantially rectangular.

A preferred feature of the invention is cord members that are sufficiently elastic to aid in producing the whistling sound. A further preferred feature that facilitates the manufacture of the toy is a sounding member body that includes first and second body portions having first and second cavity wall portions, respectively. The first and second cavity wall portions matingly engage each other to form the cavities when the first and second body portions are assembled together.

According to another aspect of the invention, a sounding toy is provided having a sounding member and flexible cord members, as described above. The internal cavities are defined by a peripheral portion of the sounding member circumferentially surrounding a center portion thereof. The cord members extend through radially spaced portions of the center portion. Each cord member extends from opposite sides of the sounding member to first and second opposite end portions. The toy further comprises first and second gripping members attached to the first end portions and the second end portions, respectively, of the cord members. The shape of the gripping members may be varied. Preferably, they are D-shaped.

The invention has a number of advantages. These advantages, the features of the invention discussed above, and further features will become apparent from the detailed description of the best mode for carrying out the invention that follows.

BRIEF DESCRIPTION OF THE DRAWINGS

In the drawings, like element designations refer to like parts throughout, and:

FIG. 1 is a pictorial view of the preferred embodiment of the invention.

FIG. 2 is an exploded pictorial view of the sounding member shown in FIG. 1.

FIG. 3 is a fragmentary sectional view taken substantially along the like 3—3 in FIG. 1.

FIG. 6A is a plan view of the toy shown in FIG. 1, including tangents and radii shown in broken lines and two cavities shown in phantom to illustrate the geometry of the sounding member.

FIG. 6B is a plan view of the toy shown in FIG. 1 and further includes a circumscribing circle shown in broken line.

FIG. 7 is a side view of the toy shown in FIG. 1 with portions of the flexible cord members broken off to facilitate illustration.

BEST MODE FOR CARRYING OUT THE INVENTION

Figure 4:
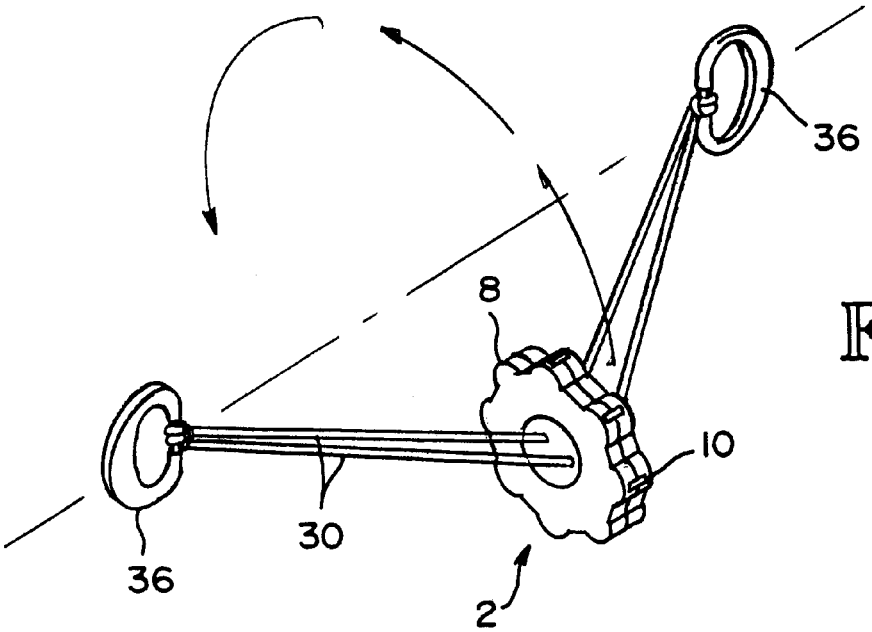
FIGS. 4 and 5 are pictorial views illustrating the use of the toy shown in FIG. 1.
Figure 5:
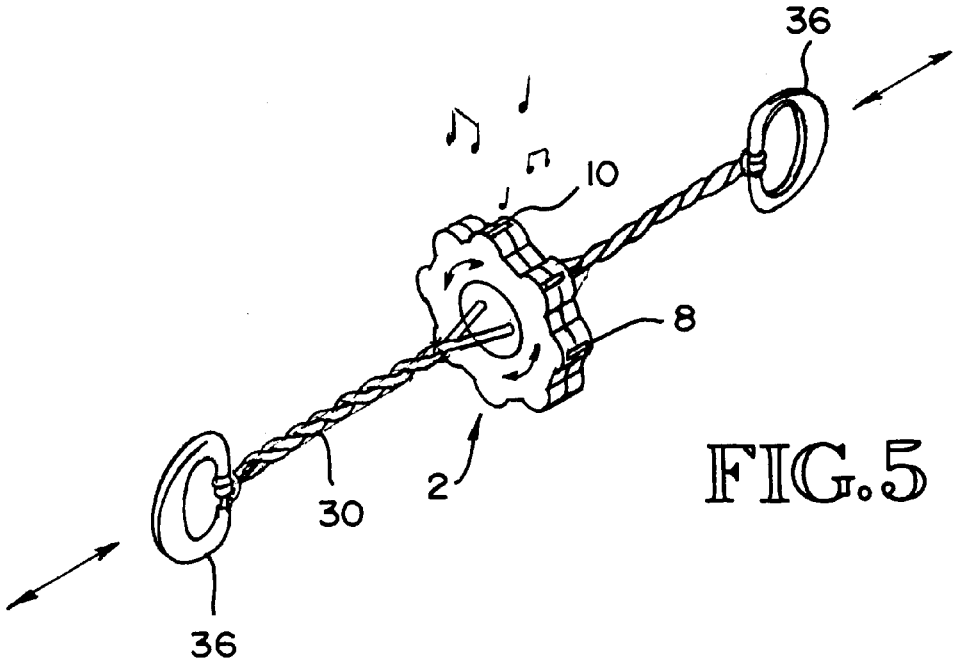

The drawings show a sounding toy that is constructed according to the invention and that constitutes the best mode for carrying out the invention currently known to the applicant. The use of the invention to produce a whistling sound is illustrated in FIGS. 4 and 5.

Referring to FIG. 1, the sounding toy of the invention includes a substantially flat, substantially round, disc-like sounding member 2. The body of the sounding member 2 has a peripheral portion 4 bounded by an outer circumferential sidewall 6. The sidewall 6 is substantially circular, and its outer surface is substantially cylindrical. A plurality of circumferentially spaced radial protuberances 8 are formed on the outer sidewall 6. A side opening 10 extends through each of the protuberances 8.

The peripheral portion 4 of the body 2 defines a plurality of circumferentially spaced internal cavities 12. The body includes a first body portion 2A and a second body portion 2B. These body portions 2A, 2B have first and second cavity wall portions 14, 16, respectively. The cavity wall portions 14, 16 matingly engage each other to form the cavities 12 when the first and second body portions 2A, 2B are assembled together to form the sounding member 2. As can be seen in FIGS. 2 and 6A, each cavity 12 is substantially circular and is defined by the respective cavity wall portions 14, 16. The radially outer portions of the cavity walls 14, 16 also define the protuberances 8. The first cavity wall portions 14 on the first body portion 2A have an inner shoulder 18 and an outer axial projection 20 adjacent to the shoulder 18. The second cavity wall portions 16 on the second body portion 2B have an outer shoulder 22 and an adjacent inner axial projection 24. Referring to FIG. 3, when the two body portions 2A, 2B are assembled together, the first shoulder 18 is engaged by the outer projection 24 and the second shoulder 22 is engaged by the inner projection 20. This interlocking engagement encloses the respective cavity 12. Each cavity is enclosed except for the side opening 10 extending through the corresponding protuberance 8 and communicating with the cavity 12.

The body of the sounding member 2 also includes a center portion 26 circumferentially surrounded by the peripheral portion 4. The opposite radial surfaces of the center portion 26 are concave, in contrast to the substantially flat radial surfaces of the peripheral portion 4. This configuration is best seen in FIG. 3. A pair of radially spaced holes 28 extend axially through the center portion 26. A flexible cord member 30 slidably extends through each hole 28.

Each cord 30 extends from the opposite radial sides of the center portion 26 to first and second opposite end portions 32, 34. The first end portions 32 of the cords 30 on one side of the sounding member 2 are attached to a first gripping member 36. The second end portions 34 on the opposite side of the sounding member 2 are attached to a second gripping member 36. The manner of attachment and the shape of the gripping members 36 may be varied. As shown in FIGS. 1, 4 and 5, the respective end portions 32, 34 are tied onto the straight side of a D-shaped gripping member 36. Each gripping member 36 preferably has a reduced diameter midportion 38 along its straight side that receives the respective ends 32, 34 of the cord members, as shown in FIG. 7. The tying of the ends 32, 34 around the reduced diameter portion 38 prevents the ends 32, 34 from undesirably sliding out of position along the side of the gripping member 36. The two cords 30 may be formed separately or may be formed by a single length of cord folded in half to produce the first and second end portions 32, 34.

The use of the sounding toy is illustrated in FIGS. 4 and 5. First, the user places one or two fingers through each of the D-shaped gripping rings 36. The respective rings 36 are gripped by the opposite hands of the user. While gripping the rings 36, the user selectively raises one hand or the other to center the sounding member 2 at midpoints along the length of the cords 30. Then, the hands are placed at an equal height but closer together than the full length of the cords 30 to allow the cords 30 some slack. The hands are rotated either toward or away from the user's body to rotate the sounding member 2 in a circular path indicated by the arrow in FIG. 4. The rotation of the sounding member 2 causes the cords 30 to wind about each other, as shown in FIG. 5. After a dozen or so rotations of the sounding member 2, the hands are moved apart, as indicated by the arrows in FIG. 5, to tighten the cords 30 into a taut straight configuration, also illustrated in FIG. 5. As the cords 30 are tightened, the sounding member 2 spins rapidly in the direction opposite to the winding direction to create a whistling sound. The play with the toy can be continued as long as desired. The cords 30 are alternately allowed to go slack and stretched, with additional winding where necessary, to repeatedly produce the whistling sound. Preferably, the cords 30 have a small degree of elasticity sufficient to enhance the production of the whistling sound.

The geometry of the sounding member 2 is specifically chosen to efficiently and reliably produce the desired whistling sound. Referring to FIGS. 6A and 6B, the side openings 10 are preferably arranged in a plurality of pairs of side openings 10 with the two side openings 10 in each pair being oriented toward a common plane. In FIG. 6A, the common plane is indicated by the tangent line 40. The plane extends perpendicularly to the drawing sheet through the tangent line 40. As can be seen in FIG. 6A, the tangent line 40 touches the adjacent edges of the two openings 10 in the pair. In contrast, adjacent openings 10 in different pairs are oriented away from each other and are farther apart than the openings 10 in a pair. The tangent line 42 in FIG. 6A illustrates this different relationship. The line 42 is tangent to the protuberances 8 through which two openings 10 belonging to different pairs extend. The tangent point on each of the protuberances 8 is spaced circumferentially away from the respective opening 10. The openings 10 in a pair are about three-quarters of an inch apart. Adjacent openings 10 in different pairs are about one and one-sixteenth inch apart.

Each of the sidewall protuberances 8 is defined by a substantially circular arc. As described above, each cavity 12 is substantially circular. Each cavity 12 is concentric with the arc of the protuberance 8 through which the corresponding side opening 10 extends. This is illustrated in FIG. 6A by the cavities 12 shown in phantom. For each pair of side openings 10, an area defined between two radial lines of the body of the sounding member 2 respectively bisecting the cavities 12 corresponding to the side openings 10 of the pair includes at least substantially the full extent of both side openings 10 of the pair. This is illustrated by the radial lines 44, 46 shown in FIG. 6A. The lines 44, 46 bisect the respective cavities 12 and essentially coincide with the outer (with respect to the pair) edges of the corresponding side openings 10 as the lines 44, 46 pass through the outer sidewall 6. In contrast, radial lines bisecting two adjacent cavities 12 belonging to different pairs do not encompass any portion of either of the corresponding side openings 10. This is illustrated by the radial lines 48, 44 in FIG. 6A and the area between such lines 48, 44.

FIG. 6B illustrates an additional geometric characteristic of the sounding member 2. FIG. 6B shows a circle 50 circumscribing the sidewall 6, including its protuberances 8. The circumscribing circle 50 substantially touches a first edge 52 of each side opening 10 and is spaced radially outwardly of a second opposite edge 54 of the side opening 10. This relationship illustrates the positioning and configuring of the side openings 10 to scoop air into the cavities 12 as the sounding member 2 is rotating to produce the desired whistling sound. Preferably, each side opening 10 is rectangular, as best seen in FIG. 7, so that the edges 52, 54 have the desired relationship to a circumscribing circle along their entire axial extent. The openings 10 in each pair are oriented toward each other and in opposite circumferential directions to scoop air in each of the two rotational directions of the sounding member 2.

The materials from which the components of the sounding toy are made may be varied. Preferably, the two portions 2A, 2B of the sounding member 2 are each made from molded plastic. Following molding, the two portions 2A, 2B are assembled together and secured in position, such as by an adhesive. The gripping members 36 are also preferably made from molded plastic. The use of molded plastic for the members 2, 36 helps to maintain a low cost of manufacture for these parts and to allow the parts to be lightweight and durable. The cords 30 may be made from various materials which have the small amount of stretch (elasticity) described above. In the currently preferred embodiment, the sounding member 2 has a diameter of about two and three-quarters inches and a thickness of about one-half inch. It weighs about three-quarters of an ounce. Each cord 30 is about 24 inches long.

Although the preferred embodiment of the invention has been illustrated and described herein, it is intended to be understood by those skilled in the art that various modifications and omissions in form and detail may be made without departing from the spirit and scope of the invention as defined by the following claims.

What is claimed is:

1. A sounding toy comprising:

a sounding member having a substantially disk-shaped body with a radially outwardly facing outer circumferential sidewall, said body defining a plurality of circumferentially spaced internal cavities, and each said cavity being enclosed except for a side opening communicating therewith and extending radially through said sidewall; and a pair of flexible cord members extending axially through a center portion of said body;

said cavities and said side openings being configured to produce a whistling sound when said sounding member is caused to rotate by winding and then tightening said cord members.

2. The sounding toy of claim 1, wherein a circle circumscribing said sidewall substantially touches a first edge of each said side opening and is spaced radially outwardly of a second opposite edge of said side opening.

3. The sounding toy of claim 1, wherein said side openings are arranged in a plurality of pairs of side openings with the two side openings in each pair being oriented toward a common plane tangent to said sidewall, and wherein, for each said cavity, at least one radial line of said body intersects, in a radially outward direction, first said cavity, then the side opening communicating with said cavity, and then said common plane.

4. The sounding toy of claim 1, wherein said sidewall is substantially circular and has a plurality of circumferentially spaced radial protuberances thereon through each of which one of said side openings extends, and said side openings are arranged in a plurality of pairs of side openings with the two side openings in each said pair being oriented toward a common plane tangent to the protuberances through which the side openings in said pair extend, and wherein, for each said cavity, at least one radial line of said body intersects, in a radially outward direction, first said cavity, then the side opening communicating with said cavity, and then said common plane.

5. The sounding toy of claim 4, wherein each said protuberance is defined by an at least substantially circular arc, and each said cavity is substantially circular and concentric with said arc of said protuberance through which the corresponding side opening extends.

6. The sounding toy of claim 5, wherein, for each pair of side openings, an area defined between two radial lines of said body respectively bisecting the cavities corresponding to said side openings of said pair includes at least substantially the full extent of both said side openings of said pair.

7. The sounding toy of claim 6, wherein each of said side openings is substantially rectangular.

8. The sounding toy of claim 5, wherein each of said side openings is substantially rectangular.

9. The sounding toy of claim 1, wherein each said cord member is sufficiently elastic to aid in producing said whistling sound.

10. The sounding toy of claim 1, wherein said body includes first and second body portions having first and second cavity wall portions, respectively; said first and second cavity wall portions matingly engaging each other to form and separate said cavities when said first and second body portions are assembled together.

11. A sounding toy comprising:

a sounding member having a center portion, and a peripheral portion circumferentially surrounding said center portion and bounded by a radially outwardly facing outer circumferential sidewall; said peripheral portion defining a plurality of circumferentially spaced internal cavities, said outer sidewall having a plurality of circumferentially spaced side openings extending radially therethrough, one side opening communicating with each said cavity, and each said cavity being enclosed except for the side opening communicating therewith;

a pair of flexible cord members extending axially through radially spaced portions of said center portion, each said cord member extending from opposite sides of said sounding member to first and second opposite end portions; and first and second gripping members attached to said first end portions and said second end portions, respectively, of said cord members;

said cavities and said side openings being configured to produce a whistling sound when said sounding member is caused to rotate by winding and then tightening said cord members.

12. The sounding toy of claim 11, wherein a circle circumscribing said sidewall substantially touches a first edge of each said side opening and is spaced radially outwardly of a second opposite edge of said side opening.

13. The sounding toy of claim 11, wherein said side openings are arranged in a plurality of pairs of side openings with the two side openings in each pair being oriented toward a common plane tangent to said sidewall, and wherein, for each said cavity, at least one radial line of said sounding member intersects, in a radially outward direction, first said cavity, then the side opening communicating with said cavity, and then said common plane.

14. The sounding toy of claim 11, wherein said outer circumferential sidewall plurality Of circumferentially spaced radial protuberances thereon through each of which one of said side openings extends, and said side openings are arranged in a plurality of pairs of side openings with the two side openings in each pair being oriented toward a common plane tangent to the protuberances through which the side openings in said pair extend, and wherein, for each said cavity, at least one radial line of said sounding member intersects, in a radially outward direction, first said cavity, then the side opening communicating with said cavity, and then said common plane.

15. The sounding toy of claim 14, wherein each said protuberance is defined by an at least substantially circular arc, and each said cavity is substantially circular and concentric with said arc of said protuberance through which the corresponding side opening extends.

16. The sounding toy of claim 15, wherein, for each pair of side openings, an area defined between two radial lines of said sounding member respectively bisecting the cavities corresponding to said side openings of said pair includes at least substantially the full extent of both said side openings of said pair.

17. The sounding toy of claim 16, wherein each of said side openings is substantially rectangular.

18. The sounding toy of claim 15, wherein each of said side openings is substantially rectangular.

19. The sounding toy of claim 11, wherein each said cord member is sufficiently elastic to aid in producing said whistling sound.

20. The sounding toy of claim 11, wherein said sounding member includes first and second body portions having first and second cavity wall portions, respectively; said first and second cavity wall portions matingly engaging each other to form and separate said cavities when said first and second body portions are assembled together.

21. The sounding toy of claim 11, wherein each of said gripping members is D-shaped.

* * * * *

UNITED STATES PATENT AND TRADEMARK OFFICE

CERTIFICATE OF CORRECTION

PATENT NO. : 6,120,342
DATED : September 19, 2000
INVENTOR(S) : Pak Nin Chan

It is certified that error appears in the above-identified patent and that said Letters Patent is hereby corrected as shown below:

Column 6,
Line 62, after "sidewall", insert -- has a --.
Line 62, "plurality Of" should be -- plurality of --.

Signed and Sealed this

Twenty-first Day of June, 2005

JON W. DUDAS
*Director of the United States Patent and Trademark Office*